US012171332B2

(12) United States Patent
Bergsma et al.

(10) Patent No.: US 12,171,332 B2
(45) Date of Patent: Dec. 24, 2024

(54) CONVERTIBLE BOOKCASE

(71) Applicant: MiEN Company, Grand Rapids, MI (US)

(72) Inventors: Remco Bergsma, Grand Rapids, MI (US); Nathan Warwick, Grand Rapids, MI (US)

( * ) Notice: Subject to any disclaimer, the term of this patent is extended or adjusted under 35 U.S.C. 154(b) by 252 days.

(21) Appl. No.: 17/663,526

(22) Filed: May 16, 2022

(65) Prior Publication Data

US 2022/0361666 A1 Nov. 17, 2022

Related U.S. Application Data

(60) Provisional application No. 63/188,865, filed on May 14, 2021.

(51) Int. Cl.
*A47B 65/00* (2006.01)
*A47B 85/00* (2006.01)

(52) U.S. Cl.
CPC ..... *A47B 65/15* (2014.12); *A47B 85/00* (2013.01)

(58) Field of Classification Search
CPC ..... A47B 65/15; A47B 85/00
USPC ..... 312/258, 194–197
See application file for complete search history.

(56) References Cited

U.S. PATENT DOCUMENTS 241,123 A * 5/1881 Danner ..... A47B 49/004 312/283
2,115,239 A * 4/1938 Strain ..... A47B 17/036 434/432
2,633,398 A * 3/1953 McAllister ..... A47B 83/001 312/285
2,694,614 A * 11/1954 Dent ..... A47B 83/001 312/196
4,759,268 A * 7/1988 Toups ..... A47B 97/00 312/194
5,863,282 A * 1/1999 Moossun ..... A47C 16/02 482/904
6,752,281 B1 * 6/2004 Mason ..... A47F 5/0018 211/195
D495,527 S * 9/2004 Walker ..... D6/657
6,951,374 B2 * 10/2005 Swenson ..... A47B 49/00 312/285
7,942,485 B2 * 5/2011 Castelluccio ..... A47B 87/00 312/195
11,064,802 B2 * 7/2021 Farjamrad ..... A47B 96/021
11,311,119 B2 * 4/2022 Durham ..... A47B 87/0253
2002/0108541 A1 * 8/2002 Grueneberg ..... A47F 5/116 312/258

(Continued)

*Primary Examiner* — Janet M Wilkens
*Assistant Examiner* — Timothy M Ayres
(74) *Attorney, Agent, or Firm* — Oppenhuizen Law PLC; David L. Oppenhuizen

(57) ABSTRACT

A bookcase is disclosed having a base, a top panel, and four sides extending vertically from the base to the top panel and defining four vertically extending corners. The bookcase also includes a plurality of corner cabinets extending along the corners and defining a plurality of compartments therebetween. Each corner cabinet includes at least one first shelf for storing books. The bookcase further includes a plurality of cabinets arranged inside the plurality of compartments. Each cabinet includes a plurality of second shelves. Each second shelf is adapted to be removed or moved to a stored position to provide leg space for a user sitting on a chair and using the top panel as a work surface.

17 Claims, 9 Drawing Sheets

(56) References Cited

U.S. PATENT DOCUMENTS

2004/0217677 A1* 11/2004 Durand ..... A47B 83/001
312/108
2008/0211360 A1* 9/2008 Eubanks ..... A47B 83/00
312/195

* cited by examiner

CONVERTIBLE BOOKCASE

CROSS REFERENCE TO RELATED APPLICATION

This application claims the benefit of U.S. Provisional Application 63/188,865, which was filed on May 14, 2021, the disclosure of which is hereby incorporated by reference.

BACKGROUND OF THE INVENTION

1. Field of the Invention

The present invention pertains to a bookcase. More particularly, the present invention pertains to a convertible bookcase adapted to be used as a table having a work surface.

2. Description of the Prior Art

Articles of furniture, such as tables, bookshelves, and seats, are typically utilized in schools, libraries and other workplaces for providing storage and a seating arrangement to a user. These articles of furniture are typically constructed as fixed units having a dedicated purpose and require more space for positioning. In addition, transportation and maneuverability is also very difficult for the furniture.

SUMMARY OF THE INVENTION

According to an aspect of the disclosure a bookcase is disclosed. The bookcase includes a base; a top panel; four sides extending vertically from the base to the top panel and defining four vertically extending corners; a plurality of corner cabinets extending along the corners and defining a plurality of compartments therebetween, each corner cabinet including at least one first shelf for storing books; and a plurality of cabinets arranged inside the plurality of compartments, each cabinet including a plurality of second shelves, and one of the second shelves being a bottom shelf, wherein each second shelf is adapted to be removed or moved to a storage position for providing a leg space for a user sitting on a chair and using the top panel as a work surface.

Optionally, the bookcase includes a plurality of castors connected to the base for supporting the bookcase on a ground surface.

Optionally, the bookcase comprises two half portions. And optionally, the half portions are identical.

Optionally, each of the half portions includes three or more castors.

Optionally, each cabinet includes a rear wall, and the rear walls of the cabinets define a storage compartment therebetween, the storage compartment being located centrally within the bookcase.

Optionally, the bookcase includes at least one tray arranged inside the storage compartment and arranged proximate to the top panel.

Optionally, the top panel defines an access opening to access the storage compartment, and the bookcase further includes a cover engaged with the top panel and adapted to selectively cover the access opening.

Optionally, each cabinet includes a rear wall and a plurality of magnets secured thereto, and the second shelves additionally include a plurality of magnets secured thereto, wherein the plurality of magnets in the rear wall align with the plurality of magnets in the second shelves so that the plurality of magnets can selectively secure the second shelves to the rear wall.

Optionally, the second shelves include a plurality of spacers and each magnet in the plurality of magnets is secured to a respective spacer in the plurality of spacers.

For a more complete understanding of the present invention, reference is made to the following detailed description and accompanying drawings. In the drawings, like reference characters refer to like parts throughout the views in which:

DETAILED DESCRIPTION OF A PREFERRED EMBODIMENT

Figure 1:
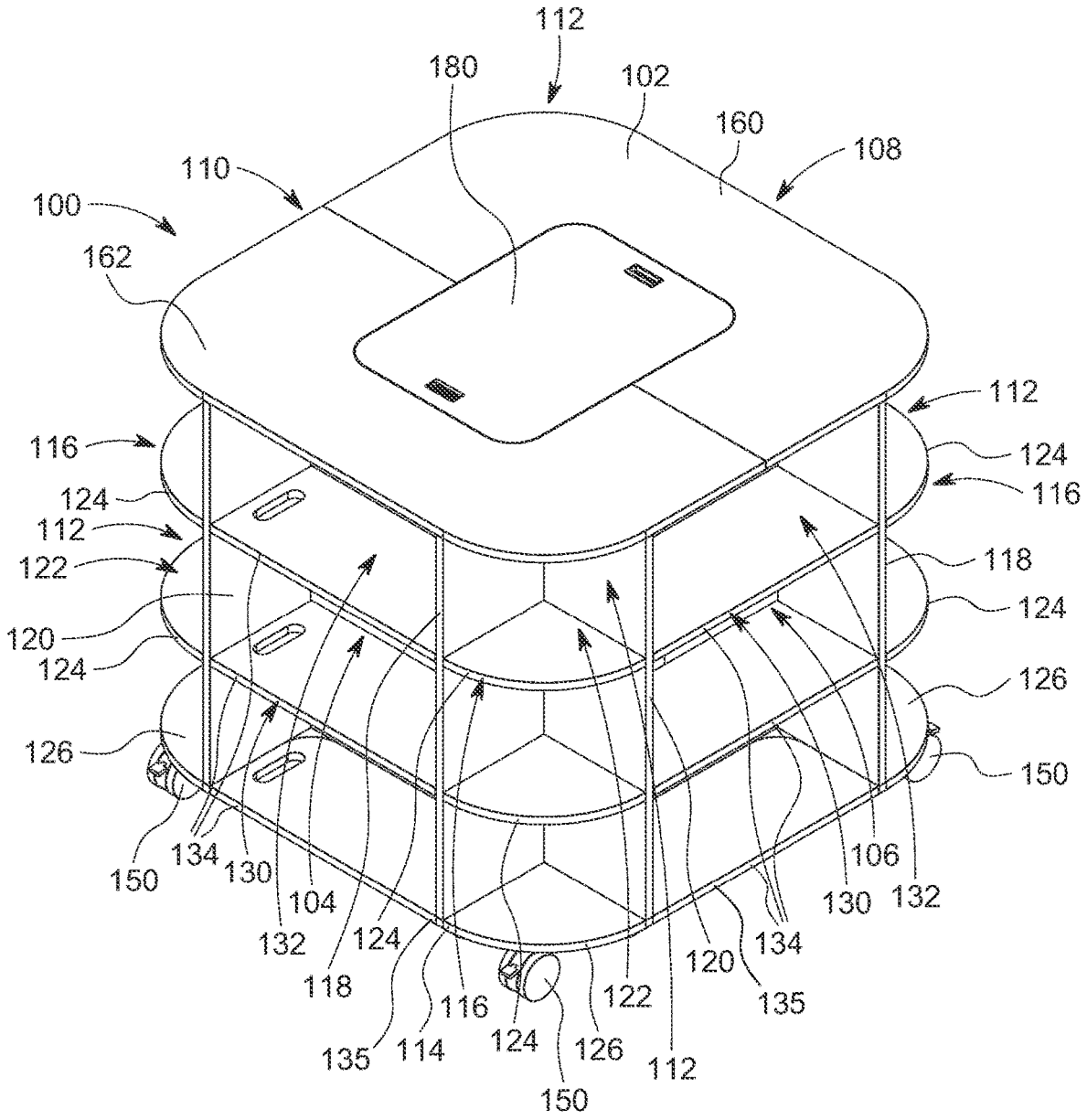
FIG. 1 illustrates a perspective view of a bookcase, in accordance with an embodiment of the disclosure.

Referring to FIGS. 1-6, a bookcase 100 suitable for use as, or conversion to, a table having a work surface is shown. The bookcase 100 includes a substantially cuboidal structure having a top panel 102, four sides 104, 106, 108, 110 extending downwardly from the top panel 102 and defining four vertically extending corners 112, and a bottom or a base 114. As shown, the bookcase 100 includes four corner cabinets 116 arranged along the four corners 112 of the bookcase 100. Each of the corner cabinets 116 is identical in construction and includes a first wall 118, a second wall 120 connected to the first wall 118 and defining a space 122 therebetween. As seen throughout the drawings, the first wall 118 and the second wall 120 are angled with respect to one another, and the first wall 118 and the second wall 120 are adjacent along a respective pair of sides. The first wall 118 and the second wall 120 are angled to extend away from one another. Preferably the first wall 118 and the second wall 120 may be oriented or angled perpendicular to one another. And even more so, the first wall 118 may be parallel to a rear wall 136 of a first adjacent side cabinet 130, while the second wall 120 may be parallel to a rear wall 136 of a second adjacent side cabinet 130. Each corner cabinet 116 includes a plurality of corner shelves 124 arranged inside the space 122 and between the base 114 and the top panel 102. In an embodiment, each corner shelf 124 includes a shape of a sector of a circle and is connected to and supported by the first wall 118 and the second wall 120. It may be appreciated that one of the corner shelves 124 is a bottom shelf 126 which is defined by a portion of the base 114 and is integrally formed with the base 114. Each corner shelf 124 of each of the corner cabinets 116 is engaged or supported via a plurality of shelf pins (not shown). In some embodiments, the bottom shelf 126 may be connected to and supported by the base 114 via a bracket (not shown) connected to the base 114.

The bookcase 100 also includes a plurality of side cabinets 130 which are preferably arranged on four sides 104, 106, 108, 110 of the bookcase 100. Each side cabinet 130 includes a compartment 132 defined between two adjacent corner cabinets 116, and a plurality of side shelves 134 arrayed vertically inside the compartment 132. The side shelves 134 are connected to the first wall 118 of the one corner cabinet 116 and the second wall 120 of the adjacent corner cabinet 116. Further, each side shelf 134 may be connected/engaged with a rear wall 136 of the side the cabinet 130. One of the side shelves 134 is a bottom shelf 135.

Figure 2:
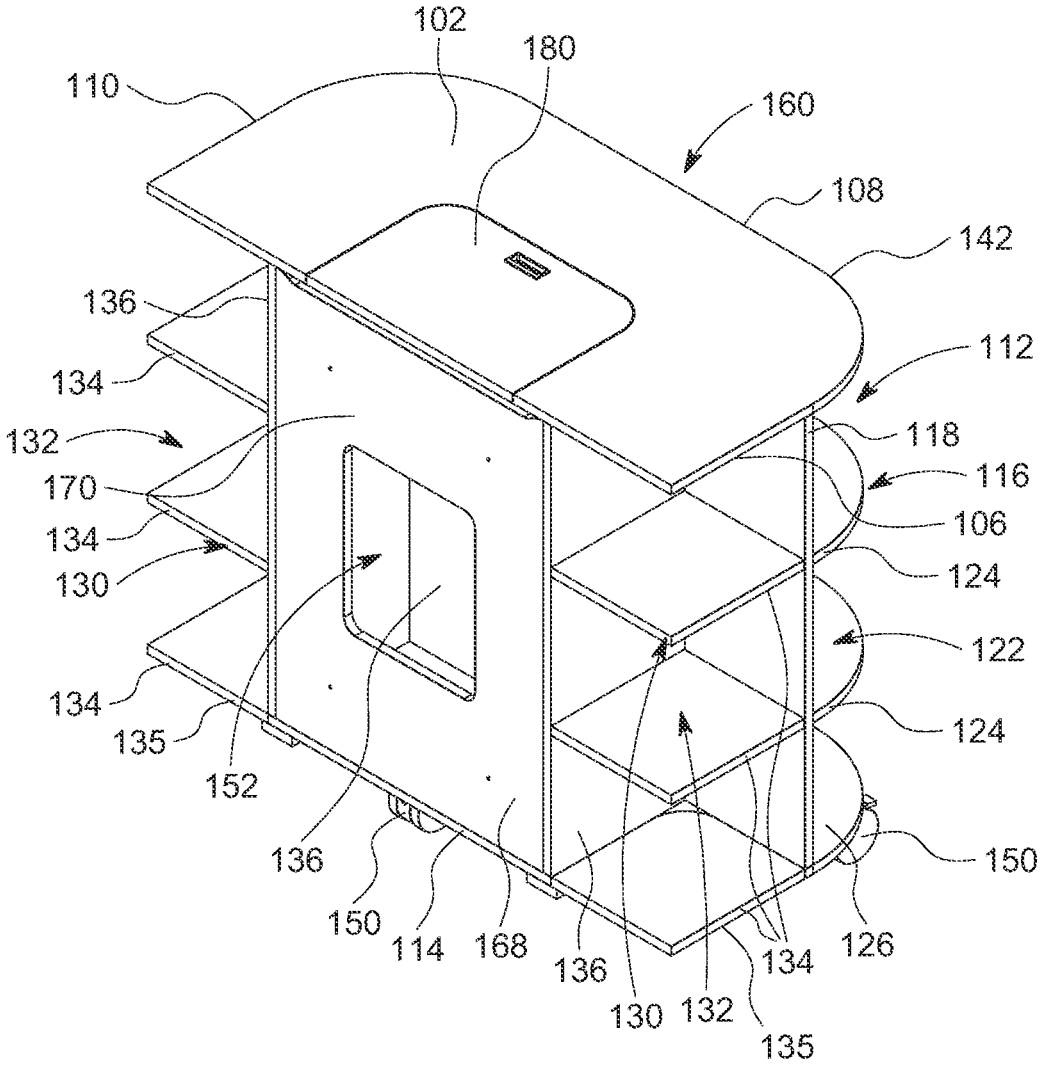
FIG. 2 illustrates a perspective view of a half portion of the bookcase, in accordance with an embodiment of the disclosure.
Figure 3:
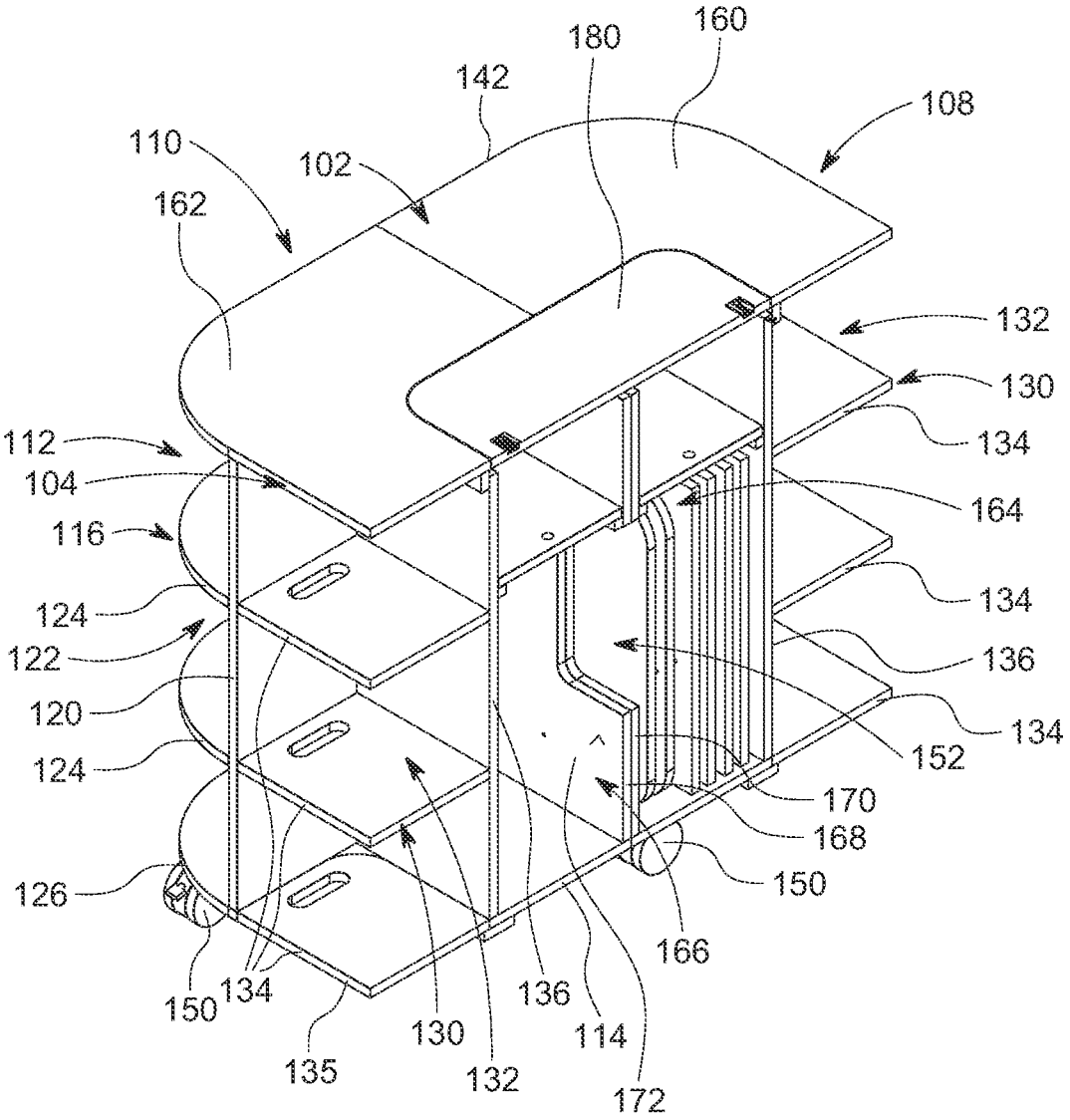
FIG. 3 illustrates a sectional perspective view of the bookcase depicting a storage compartment and a partition wall separating two halves of the bookcase, in accordance with an embodiment of the disclosure.

In an embodiment, as shown in FIGS. 1 to 3, the side shelves 134 may be removably arranged inside the compartment 132 and may be removed from the compartment 132 when needed. The side shelves 134 may be removed to provide leg space 140 for a user sitting on a chair and using the bookcase 100 as a table.

Figure 4:
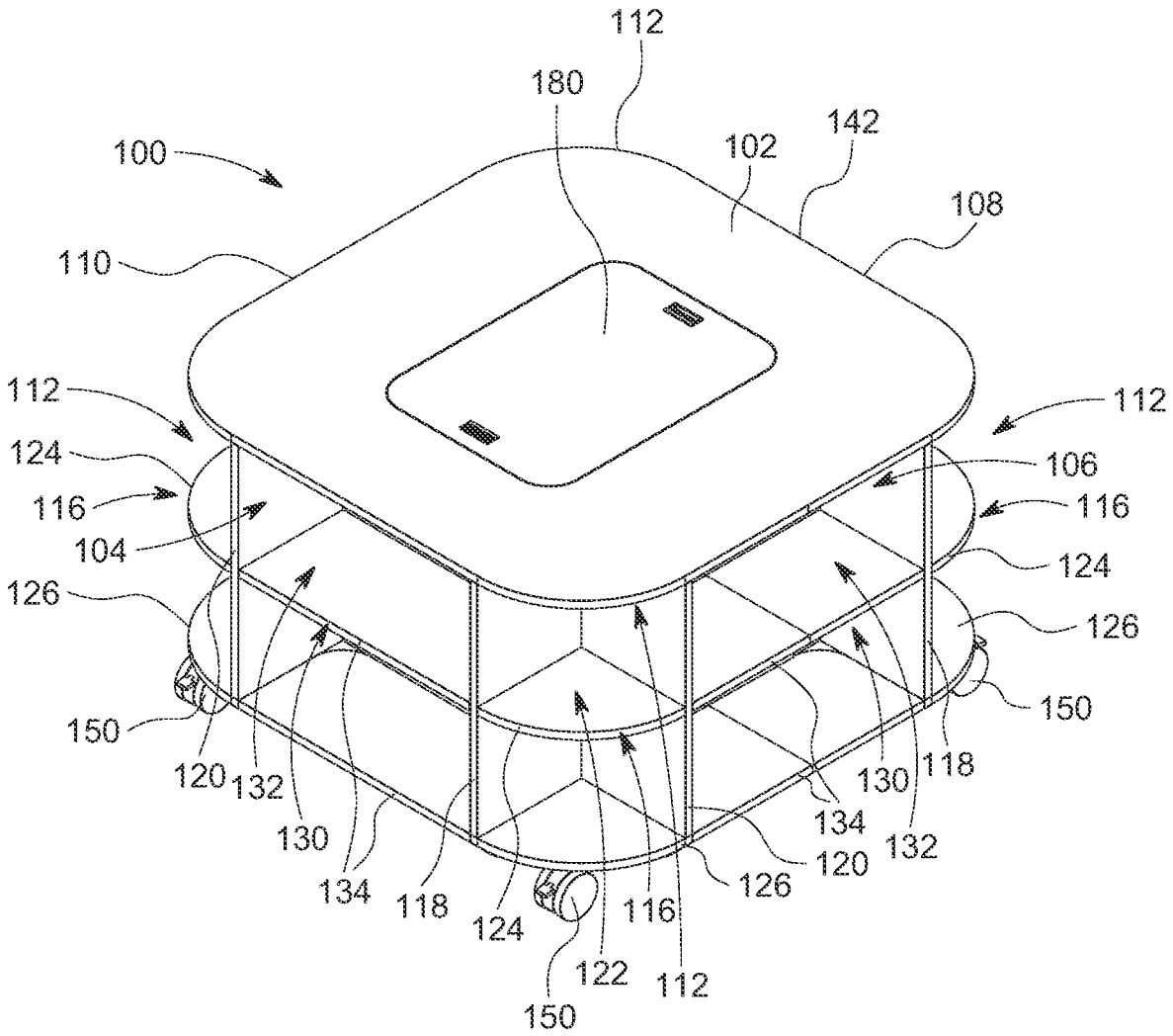
FIG. 4 illustrates a top perspective view of a bookcase depicting a cabinet having shelves arranged in a lowered position, in accordance with an embodiment of the disclosure.
Figure 5:
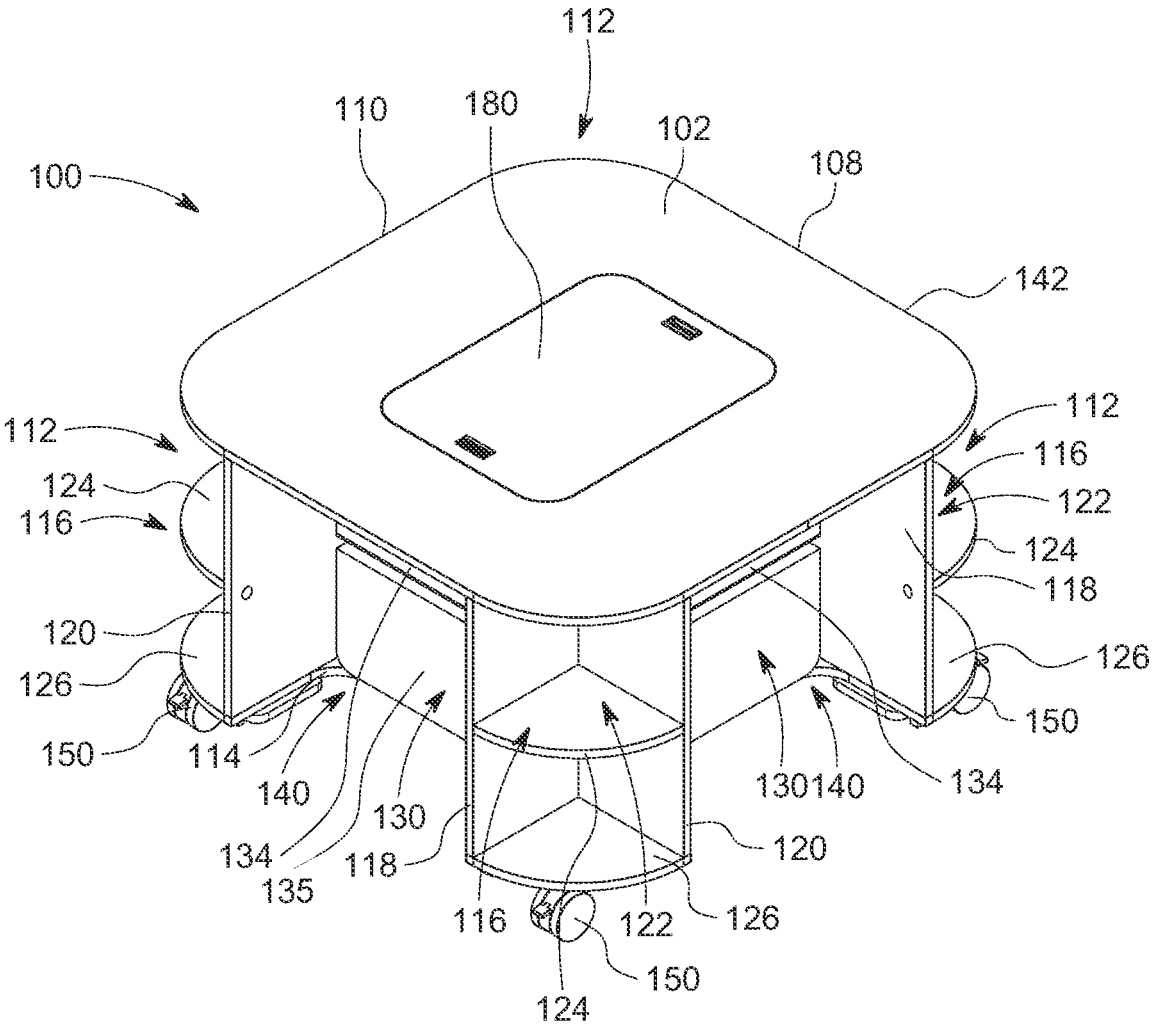
FIG. 5 illustrates a top perspective view of a bookcase depicting the cabinet having shelves arranged in a stored position, in accordance with an embodiment of the disclosure.
Figure 6:
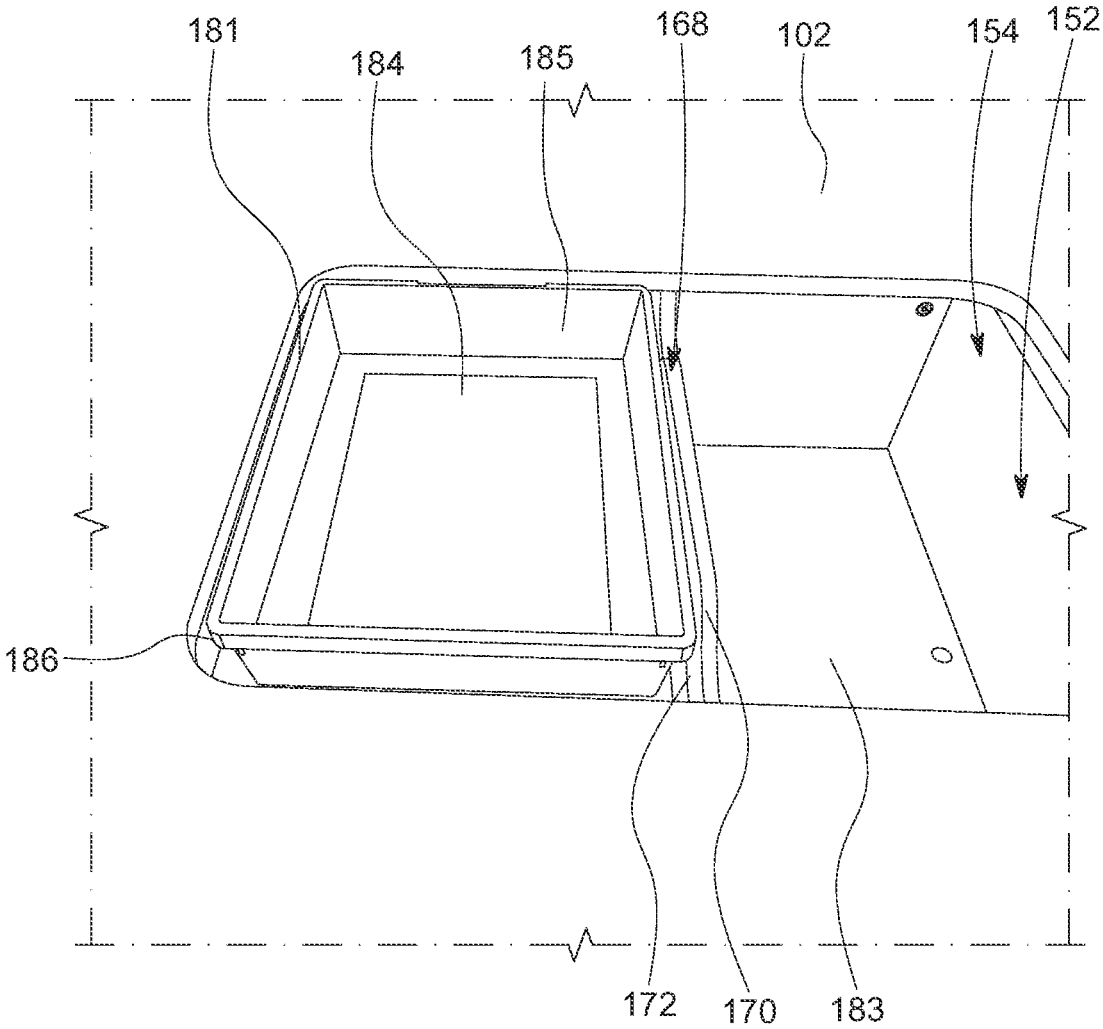
FIG. 6 illustrates a partial top view of the bookcase with a cover removed and depicting a tray arranged inside a storage compartment of the bookcase, in accordance with an embodiment of the disclosure.

In another embodiment, as shown in FIGS. 4 and 5, each of the side shelves 134 is pivotally connected to the rear wall 136 of the side cabinet 130 and is adapted to move between a lowered position (shown in FIG. 4) and a stored position (shown in FIG. 5). In the lowered position, the side shelf 134 is arranged substantially horizontally and facilitates positioning or storing of books upon the side shelf 134. In the stored position, the side shelf 134 is arranged substantially parallel to the rear wall 136 and abutting the rear wall 136 to provide the leg space 140 for a person sitting on a chair and using the top panel 102 as the work surface. In an embodiment, the rear wall 136 of each side cabinet 130 extends vertically from the base 114 to the top panel 102 and is arranged inwardly of an outer edge 142 of the top panel 102.

Furthermore, the bookcase 100 includes a plurality of castors 150 connected to the base 114 and supporting the bookcase 100 on a ground surface. The castors 150 allow movement of the bookcase 100 from one location to another. In an embodiment, one or more castor 150 includes a brake to prevent the castor 150 from rolling, and hence preventing the movement of the bookcase 100 on the ground.

As shown in FIGS. 2 and 3, the rear walls 136 of the four cabinets 130 defines a storage compartment 152 therebetween. The storage compartment 152 extends from the base 114 to the top panel 102 and is located centrally within the bookcase 100. The top panel 102 defines an access opening 154 (shown in FIG. 6) of the storage compartment 152. The access opening 154 is located substantially centrally to the top panel 102.

The bookcase 100 is preferably formed by assembling two identical half portions 160, 162, in which two of the rear walls 136, the base 114, and the top panel 102, each are formed by assembling two half panels. In an embodiment, the top panel 102 is a single panel and the bookcase 100 is split into two half portions 160, 162 by removing the top panel 102. Preferably each of the half portions 160, 162 includes three castors 150, two arranged below the bottom shelves 126 of the two corner cabinets 116, and one castor 150 arranged below and substantially centrally to the partition wall 168. Although not shown in the drawings, four castors 150 may be provided, with each castor 150 being positioned near a corner of the half panel. As shown in FIGS. 2 and 3, the storage compartment 152 includes a first storage bin 164 and a second storage bin 166 separated from the first storage bin 164 by a partition wall 168. The partition wall 168 may be formed by two panels 170, 172 abutting each other and extending vertically from the base 114 towards the top panel 102. In the assembly of two half portions 160, 162, the partition wall 168 is arranged substantially centrally to the storage compartment 152. As shown, a first panel 170 of the partition wall 168 is attached to a first half portion 160, while a second panel 172 of the partition wall 168 is attached to a second half portion 162. In some embodiments, the partition wall 168 may be omitted.

Furthermore, the bookcase 100 includes a cover 180 engaged with the top panel 102 and adapted to cover the access opening 154. Preferably, the cover 180 is engaged with the top panel 102 such that an upper surface of the cover 180 is flush and aligned with an upper surface of the top panel 102 when the cover 180 is arranged to cover the access opening 154. The bookcase 100 preferably includes at least one tray 181 (shown in FIG. 6) arranged inside the storage compartment 152 and arranged proximate to the access opening 154 to store various articles. The tray 181 is preferably generally rectangular in shape and has a bottom surface 184, a plurality of walls 185 extending upward therefrom, and an open top that allows free access into the tray 181. The tray 181 also preferably has a lip 186 that is located at a top edge of the walls 185 and the lip 186 extends outwardly therefrom. The lip 186 preferably extends around the perimeter of the top edge of the tray 181. To allow the insertion and positioning of the at least one tray 181 inside the storage compartment 152, the lip 186 can be positioned atop, and supported by, a top edge of the rear walls 136 and the partition wall 168. Furthermore, the top edge of the rear walls 136 and the partition wall 168 may be sufficiently recessed below the top panel 102 (thereby lowering the tray 181 as needed) so that the cover 180 over the access opening 154 is flush with the top panel 102. The storage bins 164, 166 and the trays 181 may also be separated from each other via horizontally arranged panels 183. The tray 181 can be removed from the bookcase 100 and may be carried elsewhere in the room. Also, the bookcase 100 may be used as the table with the cover 180 removed from the bookcase 100 to facilitate an easy access of the items stored inside the tray 181 to a user. In an embodiment, the cover 180 may be positioned covering the access opening 154 to provide extra working space when the top panel 102, and hence the bookcase 100 is being used as the table.

Figure 7:
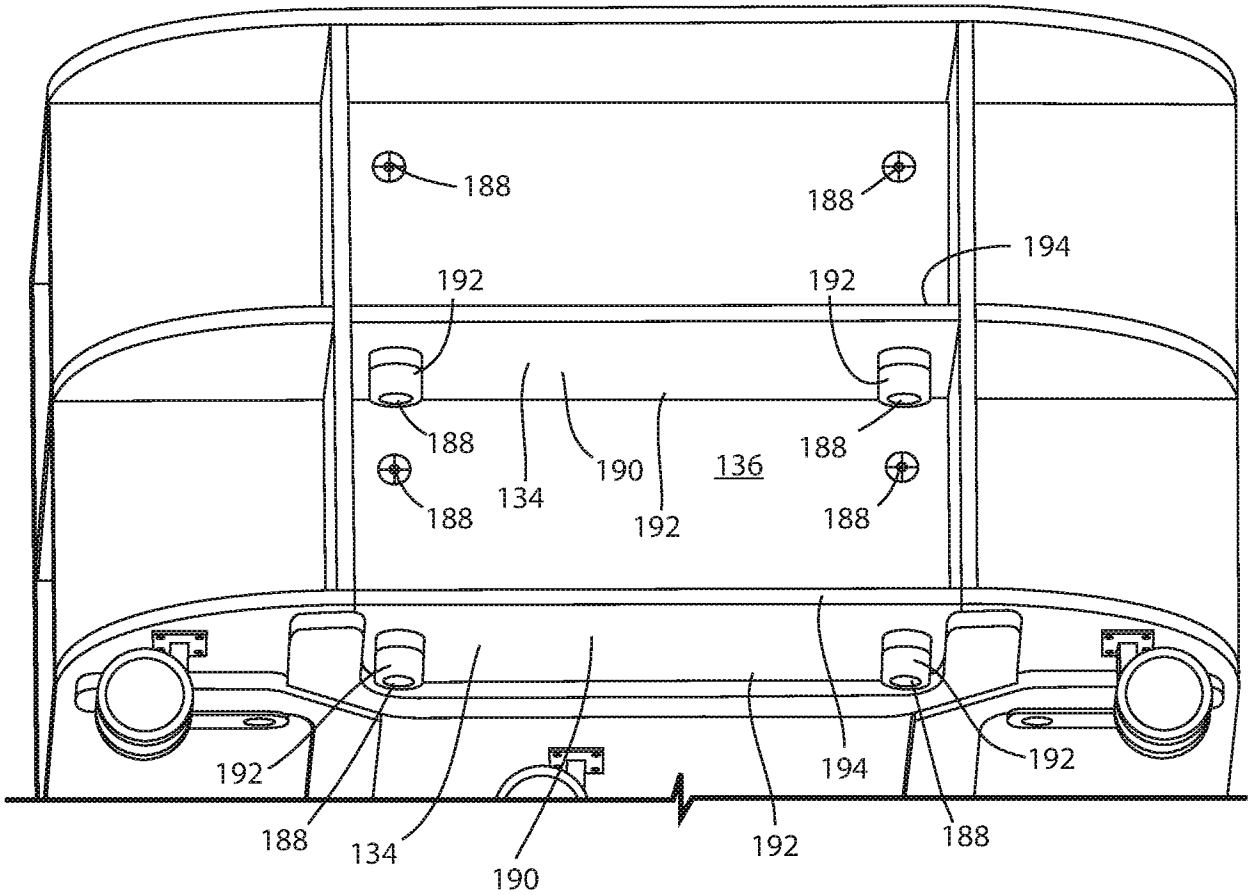
FIG. 7 illustrates a partial bottom perspective view of a bookcase depicting the cabinet having shelves arranged in a lowered position, in accordance with an alternate embodiment of the disclosure.
Figure 8:
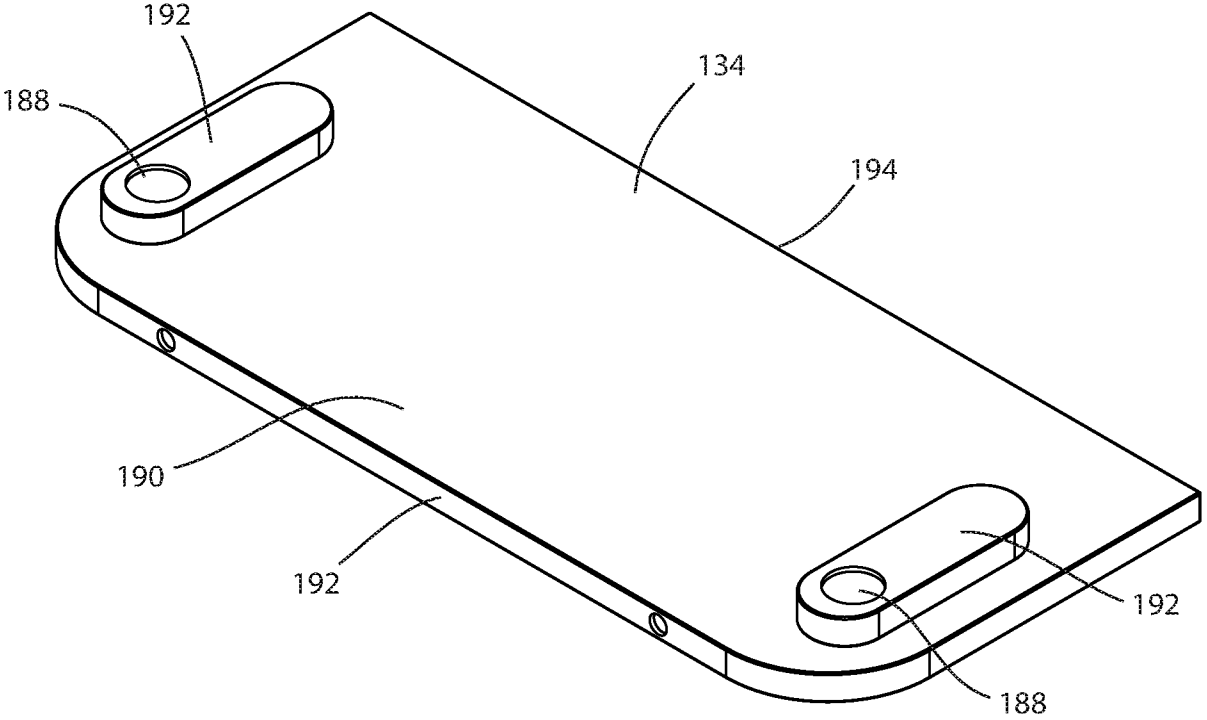
FIG. 8 is a perspective view of a removable shelf according to the embodiment shown in FIG. 7.
Figure 9:
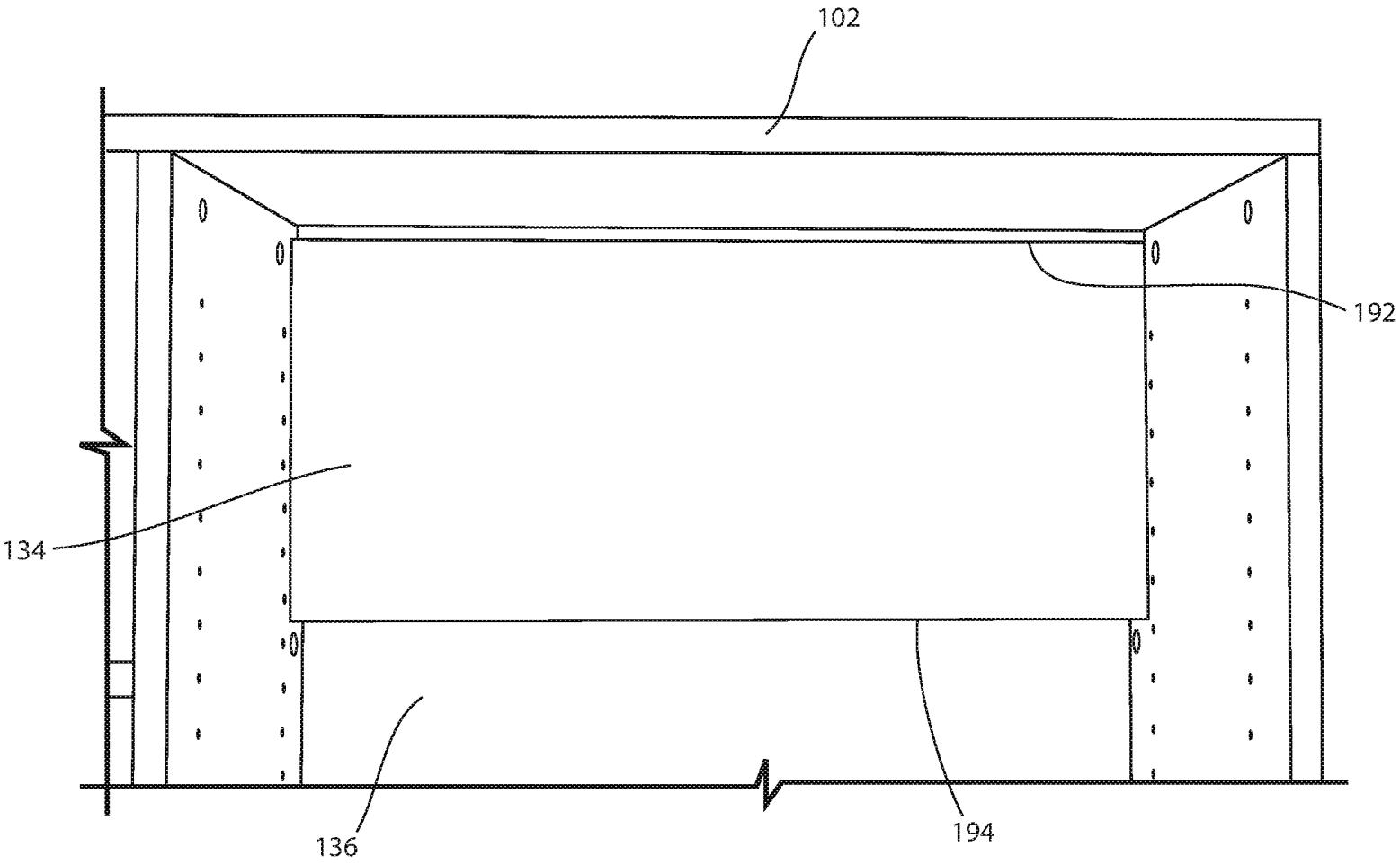
FIG. 9 is a partial view of the bookcase shown in FIG. 7 in which the shelf is arranged in a stored position.

In yet another embodiment, as shown in FIGS. 7-9, each of the side shelves 134 are removable from the side wall 136 of the side cabinet 130 and are adapted to move between a lowered position (shown in FIG. 7) and a stored position (shown in FIG. 9). In the lowered position, the side shelf 134 is arranged substantially horizontally and facilitates positioning or storing of books upon the side shelf 134. In the stored position, the side shelf 134 is arranged substantially parallel to the side wall 136 and adjacent to, but spaced apart from, the side wall 136 to provide the leg space 140 for a person sitting on a chair and using the top panel 102 as the work surface.

According to this embodiment, the rear wall 136 includes a plurality of magnets 188 which are secured to, and preferably flush with, the rear wall 136. Even more preferably, the rear wall 136 includes holes having a shape that is complementary to the magnets 188 so that the magnets 188 can be imbedded or secured therein. Shown in FIG. 8 is an embodiment of the side shelf 134 as depicted in FIGS. 7 and 9. A bottom surface 190 of the side shelf 134 includes spacers 192 which extend outward from the bottom surface 190. The spacers 192 also include holes having a shape that is complementary to the magnets 188 so that the magnets 188 can also be imbedded or secured therein. Alternatively, the magnets 188 can be secured directly to, or imbedded within, the bottom surface 190 of the side shelf 134. Importantly, the magnets 188 in the rear wall 136 align with the magnets 188 in the side shelf 134 so that the side shelf 134 can be secured in place while in the stored position due to the magnets' attractive polarity. The spacers 192 are preferably included because the spacers 192 function to space the side shelf 134 from the rear wall 136. The resulting gap between the rear wall 136 and the side shelf 134 provides a gripping location for a user to secure the side shelf 134 when the side shelf 134 is placed into or removed from the stored position.

In use, a user grasps the side shelf 134 in the lowered position shown in FIG. 7. The user then pivots the side shelf 134 so that the rear edge 192 slides upward along the rear wall 136, while the front edge 184 is angled toward the rear wall 136. The magnets 188 in the side shelf 134 are aligned with the magnets 188 in the rear wall 136, and the side shelf 134 is thereby secured into the stored position. That process is then reversed when a user desires to move the side shelf 136 from the stored position to the lowered position. And as mentioned above, the spacers 192 provide a gap between the side shelf 134 and the rear wall 136 which aids the user in quickly and easily grasping the side shelf 134.

It should be understood that the foregoing description is only illustrative of the aspects of the disclosed embodiments. Various alternatives and modifications can be devised by those skilled in the art without departing from the aspects of the disclosed embodiments. Accordingly, the aspects of the disclosed embodiments are intended to embrace all such alternatives, modifications, and variances that fall within the scope of the appended specification.

What is claimed is:

1. A bookcase comprising:

a base, a top panel, a plurality of side cabinets in which each of the side cabinets is positioned along a respective side of the bookcase, and a plurality of corner cabinets in which each of the corner cabinets is positioned at a respective corner of the bookcase, the plurality of side cabinets and the plurality of corner cabinets extending vertically between the base and the top panel and being positioned next to one another in alternating manner;

the plurality of corner cabinets each having a first wall and a second wall, the first wall and the second wall being angled with respect to one another such that the first wall and the second wall are adjacent along a respective pair of sides, and the first wall and the second wall are angled to extend away from one another, the plurality of corner cabinets including a plurality of corner shelves which are each supported by the first wall and the second wall, and the plurality of corner cabinets being open shelving free of a door or access panel; and the plurality of side cabinets each having a rear wall and being defined on each end by the first wall and the second wall of the adjacent corner cabinets from the plurality of corner cabinets, each side cabinet including a plurality of side shelves, and one of the side shelves being a bottom shelf, wherein each side shelf is adapted to be removed or moved to a storage position for providing a leg space for a user sitting on a chair and using the top panel as a work surface.

2. The bookcase of claim 1 including a plurality of castors connected to the base for supporting the bookcase on a ground surface.

3. The bookcase of claim 1 comprising two half portions.

4. The bookcase of claim 3 wherein the half portions are identical.

5. The bookcase of claim 3 wherein the rear wall of each side cabinet defines a storage compartment therebetween, the storage compartment being located centrally within the bookcase.

6. The bookcase of claim 5 including at least one tray arranged inside the storage compartment and arranged proximate to the top panel.

7. The bookcase of claim 6 wherein the top panel defines an access opening to access the storage compartment, and the bookcase further includes a cover engaged with the top panel and adapted to selectively cover the access opening.

8. The bookcase of claim 5 wherein the top panel defines an access opening to access the storage compartment, and the bookcase further includes a cover engaged with the top panel and adapted to selectively cover the access opening.

9. The bookcase of claim 3 wherein each of the half portions include three or more of the castors.

10. The bookcase of claim 1 wherein the rear wall of each side cabinet defines a storage compartment therebetween, the storage compartment being located centrally within the bookcase.

11. The bookcase of claim 10 including at least one tray arranged inside the storage compartment and arranged proximate to the top panel.

12. The bookcase of claim 11 wherein the top panel defines an access opening to access the storage compartment, and the bookcase further includes a cover engaged with the top panel and adapted to selectively cover the access opening.

13. The bookcase of claim 10 wherein the top panel defines an access opening to access the storage compartment, and the bookcase further includes a cover engaged with the top panel and adapted to selectively cover the access opening.

14. The bookcase of claim 1 wherein each rear wall includes a plurality of magnets secured thereto, and the side shelves additionally include a plurality of magnets secured thereto, wherein the plurality of magnets in the rear wall align with the plurality of magnets in the side shelves so that the plurality of magnets can selectively secure the side shelves to the rear wall.

15. The bookcase of claim 14 wherein the side shelves include a plurality of spacers and each magnet in the plurality of magnets is secured to a respective spacer in the plurality of spacers.

16. The bookcase of claim 1 wherein the first wall and the second wall are perpendicular to one another.

17. The bookcase of claim 1 wherein the first wall is parallel to the rear wall in a first adjacent side cabinet, and the second wall is parallel to the rear wall in a second adjacent side cabinet.

* * * * *